US008690299B2

(12) United States Patent
Kawamura et al.

(10) Patent No.: US 8,690,299 B2
(45) **Date of Patent: *Apr. 8, 2014**

(54) LIQUID CONTAINER

(71) Applicant: Canon Kabushiki Kaisha, Tokyo (JP)

(72) Inventors: Shogo Kawamura, Namazu (JP); Yasuo Kotaki, Yokohama (JP); Hideki Ogura, Yokohama (JP); Ryoji Inoue, Kawasaki (JP); Tetsuya Ohashi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/760,244

(22) Filed: Feb. 6, 2013

(65) Prior Publication Data

US 2013/0147884 A1 Jun. 13, 2013

Related U.S. Application Data

(63) Continuation of application No. 12/729,087, filed on Mar. 22, 2010, now Pat. No. 8,388,122, which is a continuation of application No. 11/468,916, filed on Aug. 31, 2006, now Pat. No. 7,708,394.

(30) Foreign Application Priority Data

Sep. 2, 2005 (JP) ..... 2005-255091

(51) Int. Cl.
*B41J 2/175* (2006.01)

(52) U.S. Cl.
USPC ..... 347/86

(58) Field of Classification Search
USPC ..... 347/85, 86, 87
See application file for complete search history.

(56) References Cited

U.S. PATENT DOCUMENTS

| | | | | |
|---|---|---|---|---|
| 3,876,282 | A * | 4/1975 | Schon et al. | 399/238 |
| 6,065,828 | A * | 5/2000 | Lo et al. | 347/85 |
| 6,935,739 | B2 * | 8/2005 | Inoue et al. | 347/104 |
| 7,517,069 | B2 * | 4/2009 | Sasaki et al. | 347/86 |
| 7,708,394 | B2 * | 5/2010 | Kawamura et al. | 347/86 |
| 8,388,122 | B2 * | 3/2013 | Kawamura et al. | 347/86 |

* cited by examiner

*Primary Examiner* — Anh T. N. Vo
(74) *Attorney, Agent, or Firm* — Canon U.S.A., Inc. IP Division

(57) ABSTRACT

A liquid container includes an air-tight liquid-storage chamber or reservoir, a movable member for agitating liquid, and a protrusion portion for supporting the movable member. The movable member and the protrusion portion are disposed in the liquid-storage chamber. The movable member includes a first end that is linearly movable along the protrusion portion and a second end that is free.

24 Claims, 14 Drawing Sheets

LIQUID CONTAINER

CROSS-REFERENCE TO RELATED APPLICATIONS

This application is a continuation of U.S. patent application Ser. No. 12/729,087, filed Mar. 22, 2010 which claims U.S. patent application Ser. No. 11/468,916, filed on Aug. 31, 2006, which is now U.S. Pat. No. 7,708,394 issued on May 4, 2010, which claims priority to Japanese Patent Application No. 2005-255091 filed Sep. 2, 2005, which are hereby incorporated by reference herein in their entireties.

BACKGROUND OF THE INVENTION

1. Field of the Invention

The present invention relates to liquid containers, and particularly, though not exclusively, relates to liquid containers that supply ink to ink-jet heads in ink-jet recording apparatuses.

2. Description of the Related Art

Ink-jet printers using pigmented ink are well known.

When pigmented liquid ink is used, pigment components contained in the ink settle on the bottom of the liquid containers, and as a result, the concentration of pigment components varies from the top to the bottom of the liquid containers.

In order to reduce the non-uniformity of the density inclination of the pigmented ink in the containers, an ink tank shown in FIG. 17 includes agitating fins T2008 having shafts T2007 and T2009 and weights T2010 inside the ink tank. This ink tank is disclosed in Japanese Patent Laid-Open No. 2004-216761.

When a carriage of an ink-jet printer moves, the above-described components agitate the pigmented ink in the ink tank so as to reduce the non-uniformity of the density inclination inside the ink tank.

Moreover, an ink tank shown in FIGS. 18A and 18B disclosed in the same patent includes agitating balls T2013 disposed on the bottoms of ink-storage chambers T2001 and grooves T2012 along which the balls move.

An ink tank shown in FIG. 19 disclosed in the same patent includes walls T2014 forming flow channels in ink-storage chambers T2001 such that pigmented ink flows upward in the ink-storage chambers. Furthermore, the ink tank takes air from the exterior into the ink-storage chambers.

In these ink tanks having the above-described structures, air exists in the ink-storage chambers, and the air functions as a space in which the ink can move. When carriages reciprocate in the X direction, the ink tanks on the carriages also reciprocate.

In response to this reciprocation, the pigmented ink moves toward the space in the ink-storage chambers along the walls in the ink-storage chambers. Due to the transfer of ink in the ink tanks, the non-uniformity of the density inclination of the pigmented ink in the ink tanks is reduced.

However, the ink tank shown in FIG. 17 has a large number of parts for agitating the pigment components in the ink tank, and thus has a complicated structure.

Moreover, in ink tanks that do not take air into ink-storage chambers thereof, spaces in which ink can move do not exist in the ink-storage chambers. Thus, even when carriages reciprocate, the non-uniformity of the density inclination in the entire ink tanks is hardly reduced.

SUMMARY OF THE INVENTION

The present invention is directed to a liquid container capable of agitating liquid in a liquid-storage chamber thereof with a simplified structure so as to reduce the non-uniformity of the density inclination in the liquid container.

The present invention is also directed to a liquid container capable of agitating liquid remote from a liquid-supplying portion in the liquid container in addition to that in the vicinity of the liquid-supplying portion, the liquid-supplying portion supplying liquid to a recording head.

According to one aspect of the present invention, the liquid container includes a container body including a reservoir having a flexible wall and adapted to store a liquid; a negative-pressure generating member configured to generate a negative pressure; a supply outlet facilitating supplying the liquid to the exterior; and a protrusion portion protruding toward the interior of the liquid reservoir, and a movable member whose first end is supported by the protrusion portion so as to be movable along the protrusion portion and whose second end is free.

With the above-described simplified structure, liquid remote from the liquid-supplying portion in the liquid-storage chamber can also be agitated in addition to that in the vicinity of the liquid-supplying portion, and the non-uniformity of the density inclination in the container can be reduced.

In the liquid container, the negative-pressure generating member may include an elastic member, and the elastic member may urge the flexible member in a direction away from the interior of the reservoir so as to generate a negative pressure in the liquid container.

Moreover, the movable member may include an agitating member that agitates liquid in the container in response to the movement of the liquid container and may move so as to be remote from an inner wall of the container body.

Furthermore, the second end of the movable member may move first in response to the movement of the container body, and the first end of the movable member may subsequently move along the protrusion portion.

Furthermore, the movable member may be supported by the protrusion portion so as to be movable in the same direction as the moving direction of the container body.

Moreover, the protrusion portion may be disposed on the inner wall of the container body in the horizontal direction of the liquid container in use, and may support the movable member at the upper portion of the movable member in the vertical direction.

Furthermore, the protrusion portion may be disposed in the upper portion of the inner wall of the container body of the liquid container in use, and the movable member may be suspended from the protrusion portion.

The protrusion portion may be disposed on the inner wall of the container body in the vertical direction of the liquid container in use, and may support the movable member at an end of the movable member in the horizontal direction.

The protrusion portion may be disposed in a space in the reservoir at a position remote from the supply outlet of the liquid.

The protrusion portion may be two or more protrusion portions.

Moreover, the specific gravity of the movable member and the specific gravity of the liquid stored in the reservoir may differ from each other.

As described above, according to the present invention, a liquid container capable of agitating liquid components in the container can be obtained even when air is not taken into the liquid-storage chamber of the container.

Further features of the present invention will become apparent from the following description of exemplary embodiments with reference to the attached drawings.

BRIEF DESCRIPTION OF THE DRAWINGS

FIGS. 5A to 5D illustrate first to fourth states, respectively.

FIGS. 6A to 6D illustrate the first to fourth states, respectively.

DESCRIPTION OF THE EMBODIMENTS

Embodiments of the present invention will now be described with reference to the drawings.

First Embodiment

First, an ink-jet recording apparatus including a liquid container according to a first exemplary embodiment of the present invention will be described.

Ink-jet recording apparatuses are of a non-impact type that can record on various recording media at high speed yet with little noise during recording.

Ink-jet recording apparatuses are in widespread use as recording mechanisms for printers, word processors, facsimile machines, copying machines, and the like.

Figure 15:
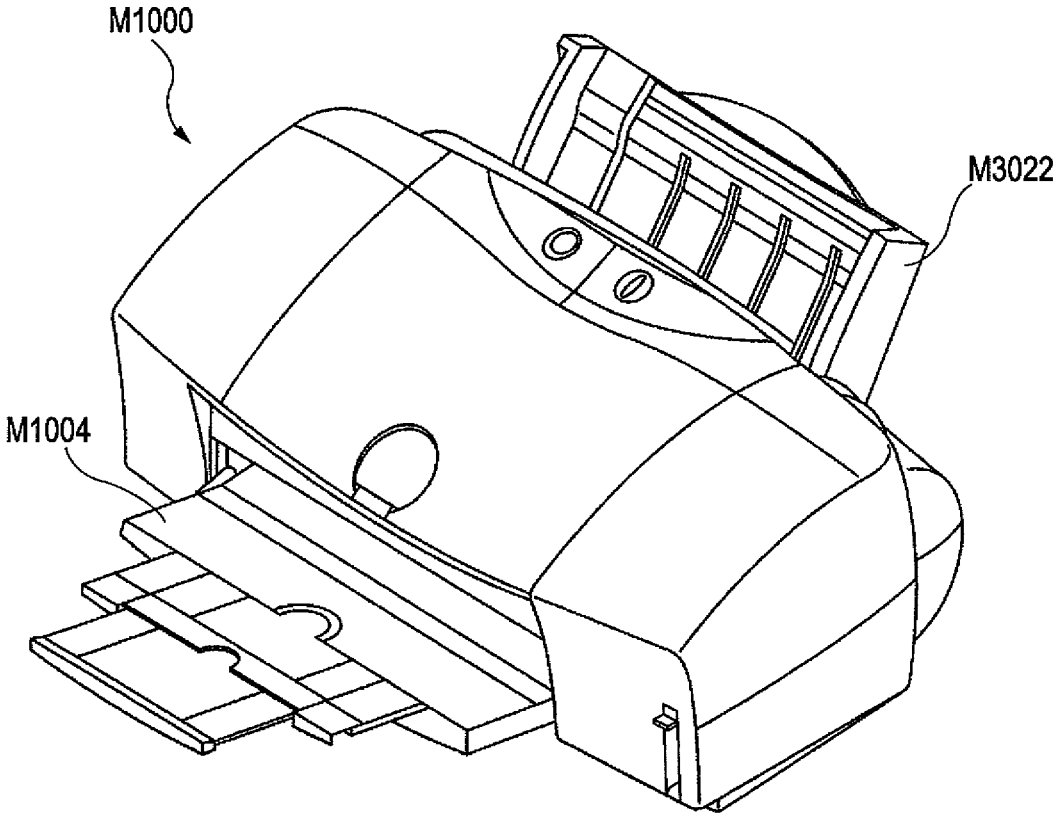
FIG. 15 is a perspective view of an ink-jet recording apparatus.

Basically, one such ink-jet recording apparatus includes a body M1000, a feeding section M3022 that feeds recording media such as paper, and an ejecting tray M1004 as shown in FIG. 15.

Figure 16:
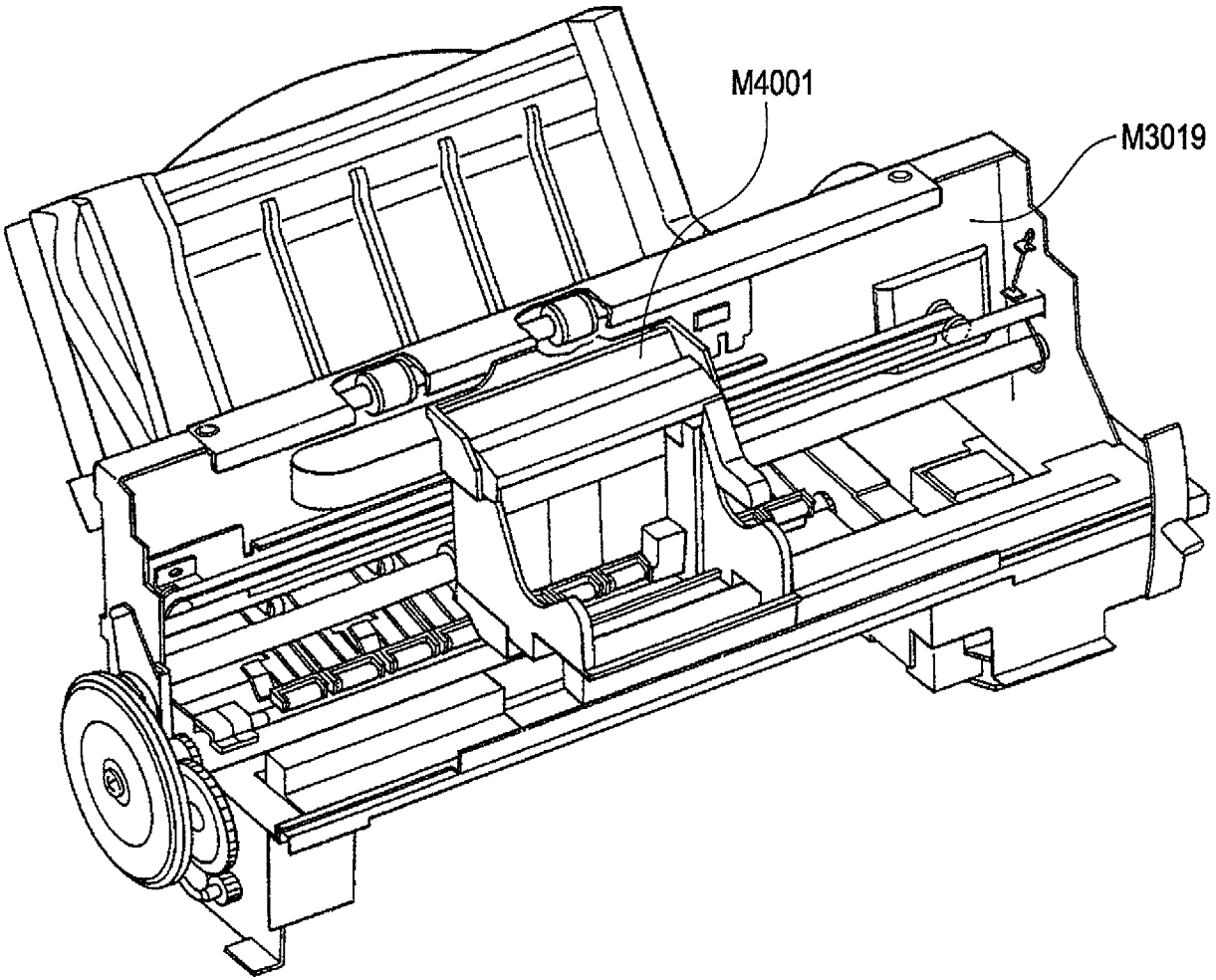
FIG. 16 is a perspective view illustrating the internal structure of the ink-jet recording apparatus.
Figure 17:
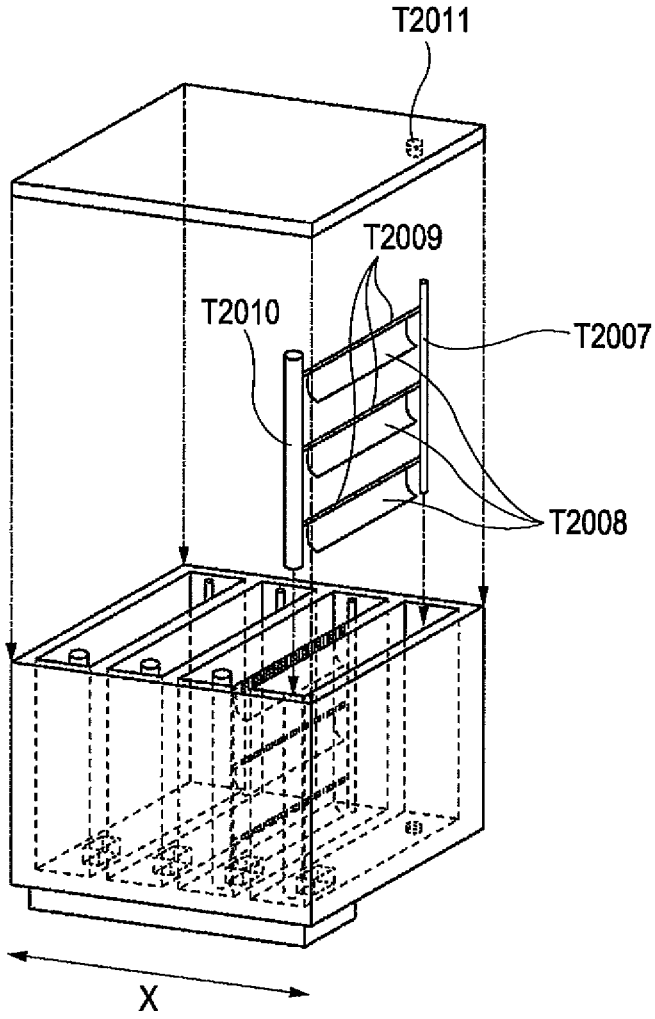
FIG. 17 PRIOR ART
FIG. 17 illustrates an ink tank according to a known technology disclosed in Japanese Patent Laid-Open No. 2004-216761.
Figure 18A:
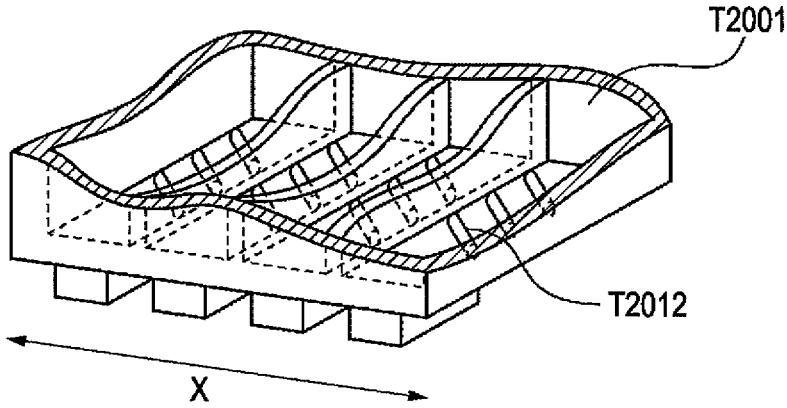
FIG. 18A PRIOR ART
FIGS. 18A and 18B illustrate another ink tank according to the known technology disclosed in Japanese Patent Laid-Open No. 2004-216761.
Figure 18B:
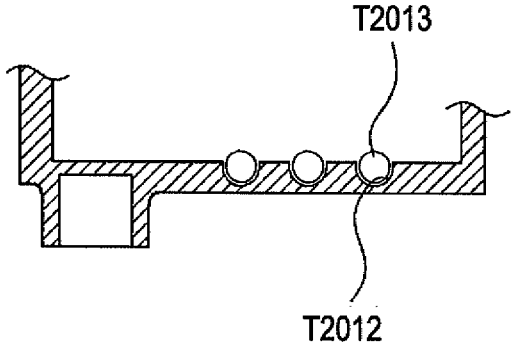
FIG. 18B PRIOR ART
Figure 19:
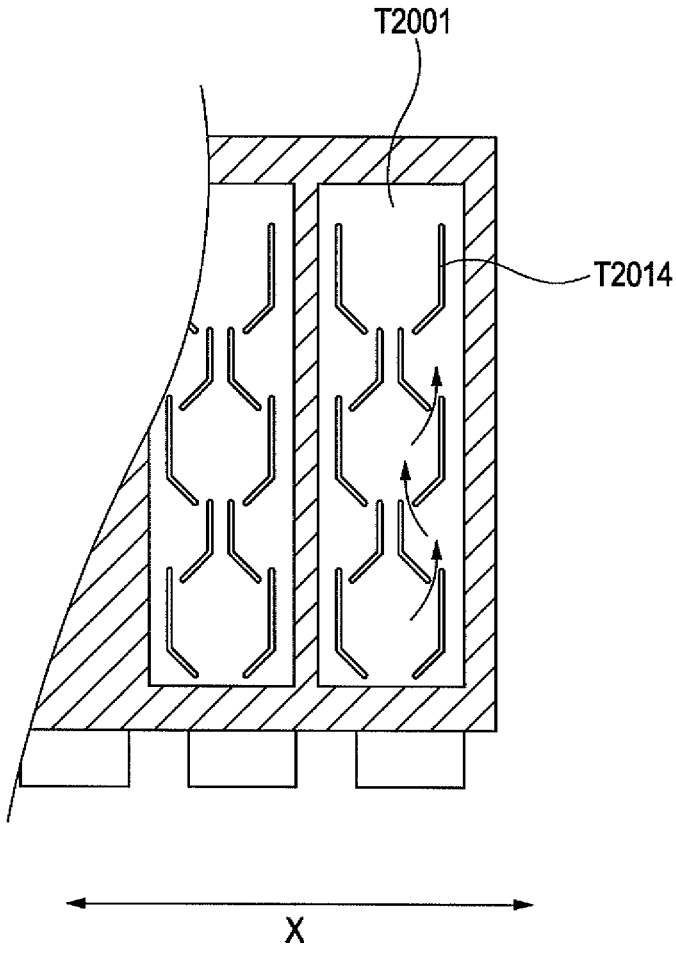
FIG. 19 PRIOR ART
FIG. 19 illustrates yet another ink tank according to the known technology disclosed in Japanese Patent Laid-Open No. 2004-216761.

As shown in FIG. 16, the ink-jet recording apparatus includes a chassis M3019 and recording mechanisms inside the body thereof. A detachable recording-head cartridge (not shown) for recording on recording sheets that are fed to a recording position is attached to a carriage M4001.

The recording-head cartridge includes a recording head that ejects liquid and an ink tank detachable from the head. The recording head heats ink by use of electrothermal transducers having heating resistors, and ejects ink droplets from outlets by the action of film boiling.

Next, the structure of the liquid container according to the present invention installed in such ink-jet recording apparatuses will be described with reference to FIGS. 1 to 4.

Figure 1:
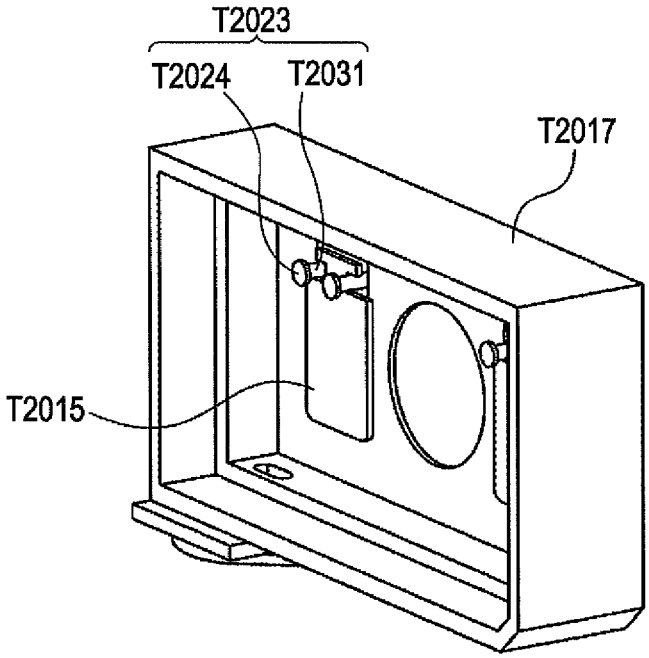
FIG. 1 is a perspective view illustrating the internal structure of a liquid container according to a first exemplary embodiment of the present invention.
Figure 2:
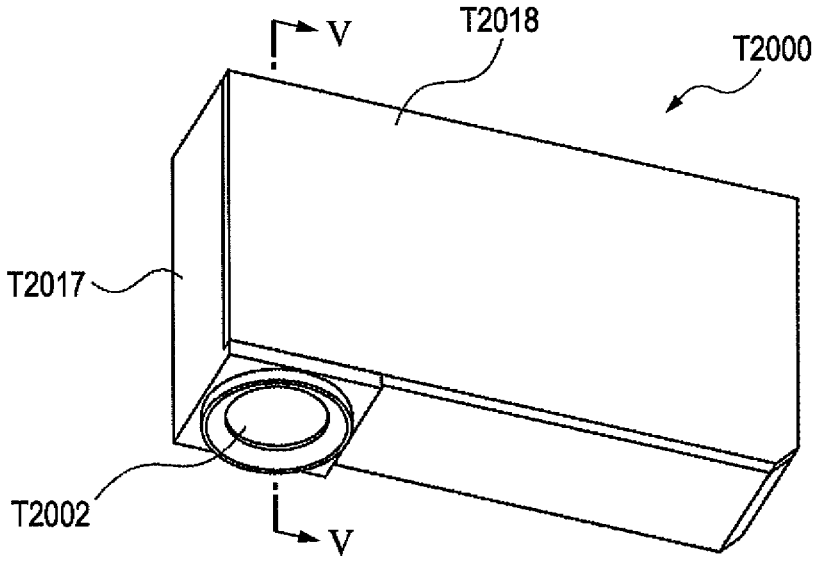
FIG. 2 is a perspective view illustrating the external structure of the liquid container according to the first exemplary embodiment of the present invention.
Figure 3A:
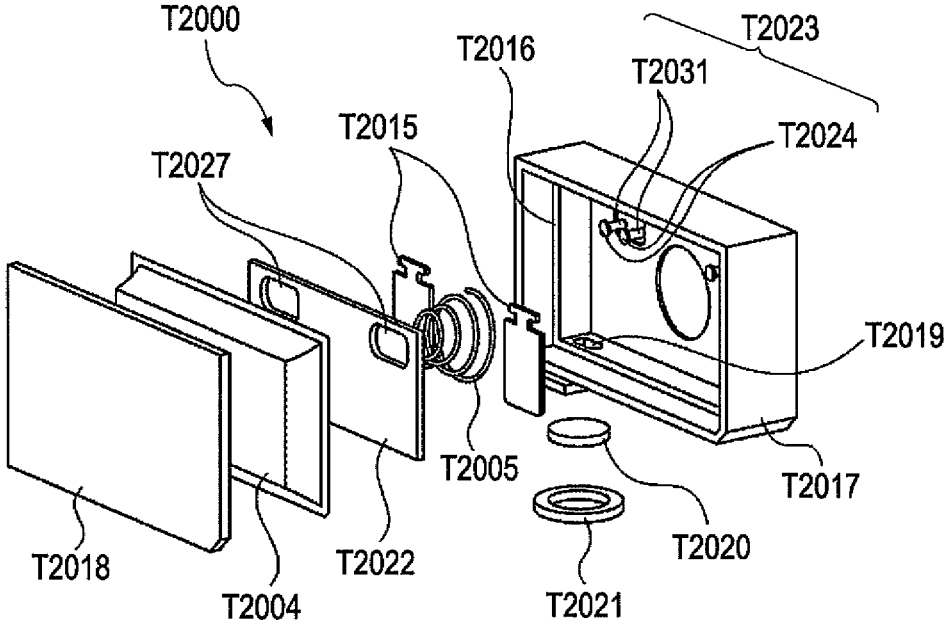
FIG. 3A is an exploded perspective view of the liquid container according to the first exemplary embodiment of the present invention.
Figure 3B:
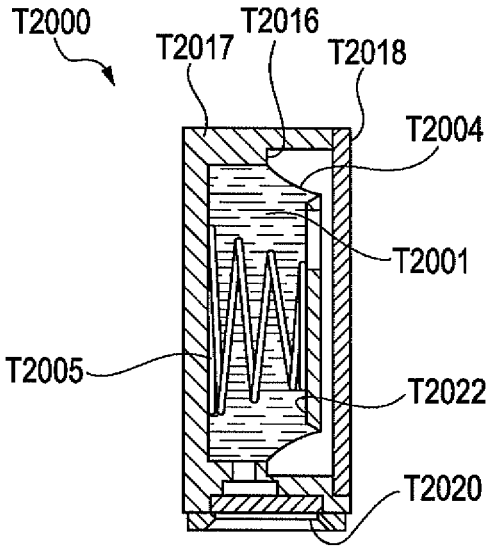
FIG. 3B is a cross-sectional view illustrating how a negative pressure is generated in the liquid container.
Figure 4A:
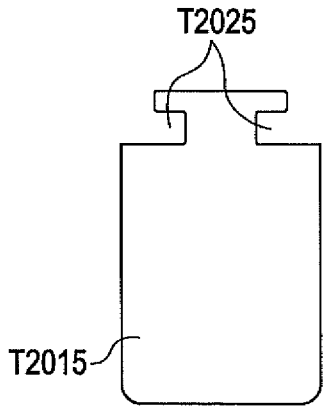
FIGS. 4A and 4B are schematic views of agitating members.
Figure 4B:
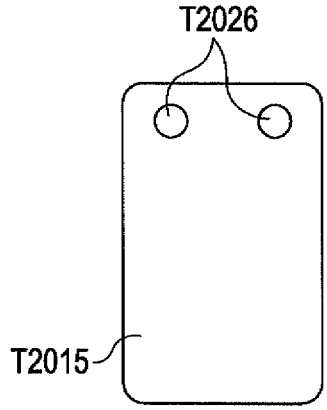

FIG. 1 is a perspective view illustrating the internal structure of the liquid container according to the first exemplary embodiment of the present invention, FIG. 2 is a perspective view illustrating the external structure, FIG. 3A is an exploded perspective view of the liquid container, FIG. 3B is a cross-sectional view illustrating how a negative pressure is generated in a liquid-storage chamber of the liquid container, and FIGS. 4A and 4B are schematic views of agitating members.

[Overall Structure]

An ink tank T2000, which is a container that stores ink, includes a casing T2017 and a cover T2018 when viewed from the exterior thereof as shown in FIG. 2, and has an ink-storage chamber in the interior thereof.

The ink tank T2000 includes the casing T2017, a biasing member such as a spring T2005 (shown in FIG. 3A), a plate T2022, a flexible film T2004, the cover T2018, a meniscus-forming member T2020, a retaining member T2021, and agitating members T2015.

The agitating members are rigid bodies that have specific gravities higher than that of ink, and have weights or stiffnesses with which the agitating members can move in ink by action of inertial force. The casing T2017 is composed of, for example, polypropylene. The meniscus-forming member is disposed on the bottom of the container body and the retaining member is attached to the exterior as shown in FIGS. 3A and 5.

The meniscus-forming member is composed of a fiber such as polypropylene, and is formed of a capillary member having capillary force alone, or a capillary member and a filter in combination. The filter has an aperture range of approximately 15 to 30 μm, and is composed of stainless steel, polypropylene, or the like.

The meniscus-forming member and the interior of the container body communicate with each other via an ink channel T2019 such that a meniscus is formed. The meniscus prevents air that causes bubbles from entering the interior of the ink-storage chamber from the exterior.

An ink-storage chamber T2001 is formed by welding or otherwise attaching the flexible film onto an inner peripheral portion T2016 of the casing T2017 so as to form a wall of a reservoir for storing liquid ink.

The flexible film is a film member having a thickness of approximately 20 to 100 μm including a thin film of polypropylene.

In the ink-storage chamber, the flexible film is urged by the biasing member such as the spring via the plate T2022 toward the exterior of the ink tank as shown in FIG. 3B such that a negative pressure (i.e. a pressure less than atmospheric pressure) is generated in the container. As shown in FIG. 3A, the spring is disposed at a position where the spring does not interfere with the agitating members T2015 in the container.

The spring and the plate are composed of stainless steel.

The cover T2018 is attached to the opening of the casing so as to protect the flexible film that protrudes toward the exterior of the container.

With this structure, the spring and the flexible film contract such that the capacity of the ink-storage chamber is gradually reduced as the ink in the ink-storage chamber is supplied to and consumed by the recording head.

The plate T2022 has openings T2027 for avoiding the interference with supporting members (described below), and thus the ink inside the ink-storage chamber can be consumed until the plate comes into contact with the inner wall of the container body.

[Structure of Agitating Mechanism]

Next, the structure of the mechanism for agitating ink in the ink-storage chamber T2001 will be described.

This exemplary embodiment includes two agitating mechanisms having the spring T2005 interposed therebetween.

These agitating mechanisms include supporting members T2023 formed on the inner wall of the container body and agitating members T2015. The supporting members support a first end of each of the agitating members.

The supporting members include shafts T2031 and retaining portions T2024, the shafts extending parallel to the moving direction of the carriage of the apparatus. In this exemplary embodiment, the supporting members correspond to rivet-shaped bosses formed on the container body, the ends of the bosses being expanded by heating.

Figure 7:
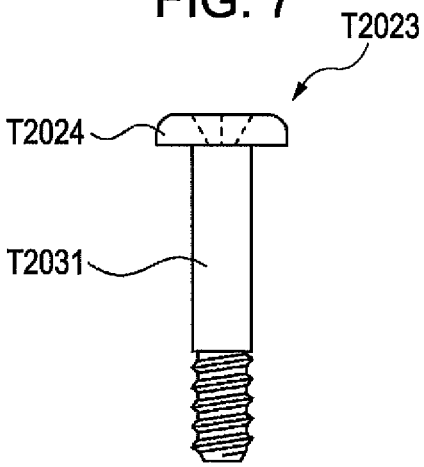
FIG. 7 is a schematic view of a supporting member according to the first exemplary embodiment of the present invention.

The supporting members may be screws as shown in FIG. 7 including heads and shafts T2031 that have smooth surfaces and are perpendicular to the heads. The screws, whose threads are embedded in the container body, can function as the supporting members with the smooth shafts T2031 and the heads serving as the retaining portions.

FIGS. 4A and 4B illustrate two examples of agitating members T2015. The agitating member shown in FIG. 4A is a plate having slots T2025 at the first end thereof, the supporting members being fitted into the slots T2025. The agitating member shown in FIG. 4B has holes T2026 at the first end thereof, the supporting members being fitted into the holes T2026. In this exemplary embodiment, these agitating members are composed of stainless steel. However, the material is not limited to stainless steel, and may be any material having a specific gravity that is different from that of ink, for example, resin.

The supporting members are attached to the container body so as to ensure a space in which the agitating members can move in response to the movement of the carriage. The shafts of the supporting members are fitted into the slots T2025 of the agitating members so as to leave clearances. Thus, the agitating members are supported by the two supporting members that pinch the two slots of the agitating members.

In this exemplary embodiment, two supporting members T2023 are disposed parallel to the moving direction of the carriage. Due to the clearances between the agitating members and the supporting members, the agitating members rotate about the contact portions of the agitating members and the supporting members, which serve as rotation axes, in response to the movement of the carriage. The rotation of the agitating members about the rotation axes effectively agitates the ink in the container. If only one rod is provided as a supporting member, the agitating members are supported by points instead of the rotation axes for rotating the agitating members. Therefore, the agitating members are subjected to unacceptable resistance from the ink in the container in response to the movement of the carriage, and unstably sway in the ink-storage chamber. Thus, the agitation of the ink in the container becomes ineffective.

The agitating members are supported by the container body at the first end of each agitating member via the supporting members. The agitating members are linearly movable along the shafts of the supporting members, and at the same time, rotatable about the supporting members in response to the movement of the carriage.

[Operation of Agitating Mechanism]

Figure 5A:
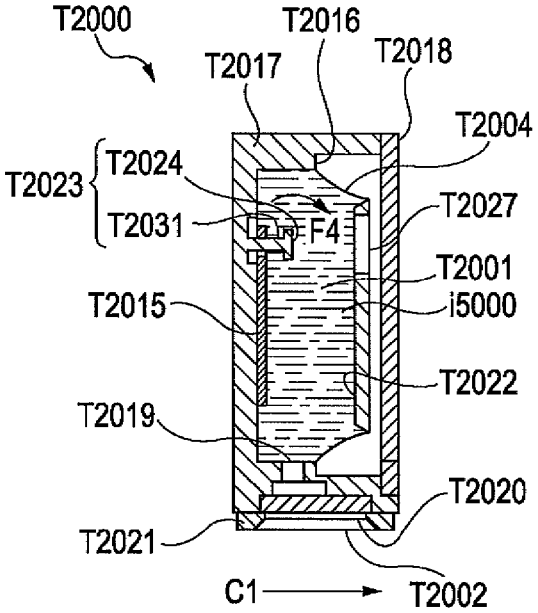
FIGS. 5A to 5D are cross-sectional views taken along line V-V in FIG. 2 illustrating the operations of the agitating member in the liquid container according to the first exemplary embodiment of the present invention.
Figure 6A:
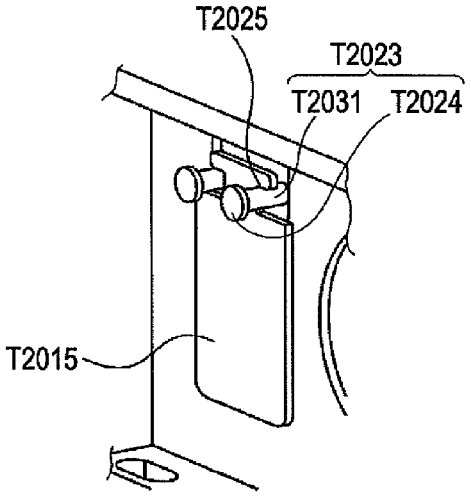
FIGS. 6A to 6D are perspective views illustrating the operations of the agitating member in the liquid container according to the first exemplary embodiment of the present invention.

FIGS. 5A and 6A illustrate a first state of an agitating member T2015.

When the ink tank T2000 moves in the direction of an arrow C1 in connection with the movement of the carriage of the apparatus, the agitating member T2015 in the ink-storage chamber T2001 is pressed against the inner wall of the casing T2017 by action of inertial force.

Figure 5B:
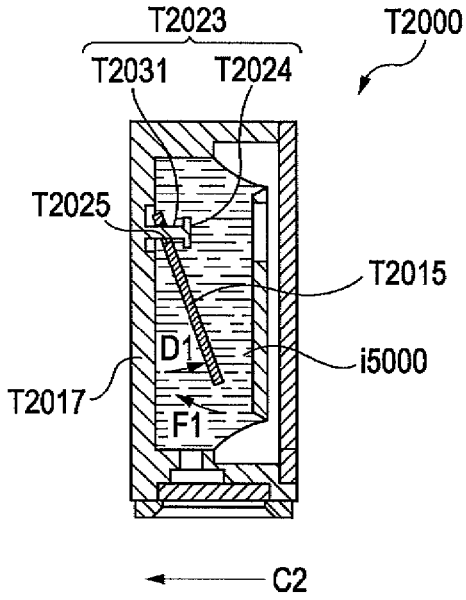
Figure 6B:
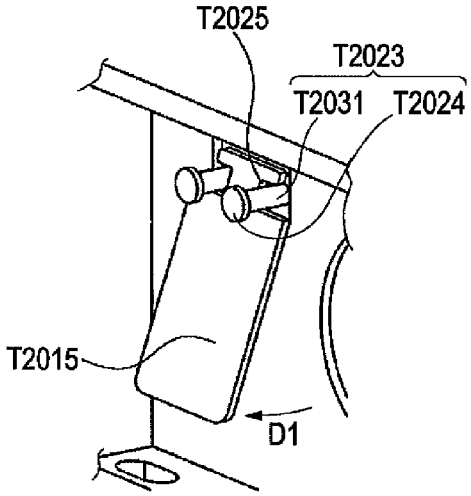

FIGS. 5B and 6B illustrate a second state of the agitating member T2015.

Since the carriage moves in the range of a printing width, the carriage reverses at a certain position and starts moving in the opposite direction. With this, the ink tank starts moving in the direction of an arrow C2.

At this time, a second end (free end) of the agitating member starts rotating about the supporting members T2023 in the direction of an arrow D1 by action of inertial force.

The range of the rotational angle depends on the clearances between the slots T2025 of the agitating member and the shafts of the supporting members T2023. When the second end of the agitating member is separated from the container body, ink flows into a space between the agitating member and the container body in the direction of an arrow F1.

Figure 5C:
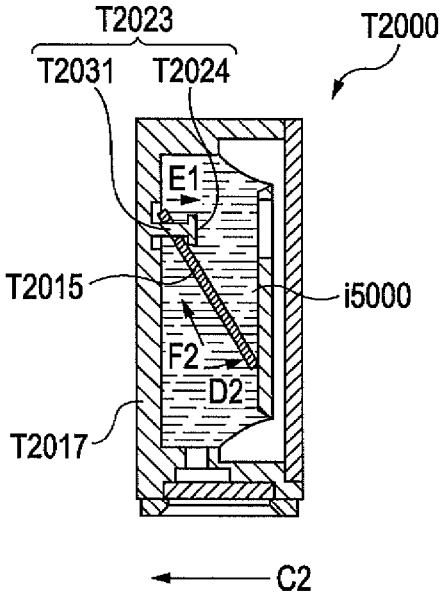
Figure 6C:
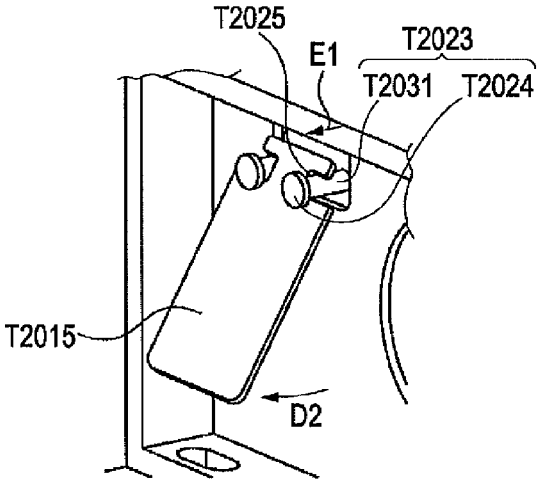

FIGS. 5C and 6C illustrate a third state of the agitating member T2015.

When the ink tank further moves in the direction of the arrow C2, the first end of the agitating member (adjacent to the supporting members) also starts moving by action of inertial force. Thus, the entire agitating member moves along the shafts of the supporting members T2023 in the direction of an arrow E1.

When the first end of the agitating member is separated from the inner wall of the container body and comes into contact with the retaining portions T2024, the second end of the agitating member further rotates in the direction of an arrow D2.

As a result, a space is created by the transfer of the first end of the agitating member in the direction of the arrow E1, and the ink flows into the space in the direction of an arrow F2.

Figure 5D:
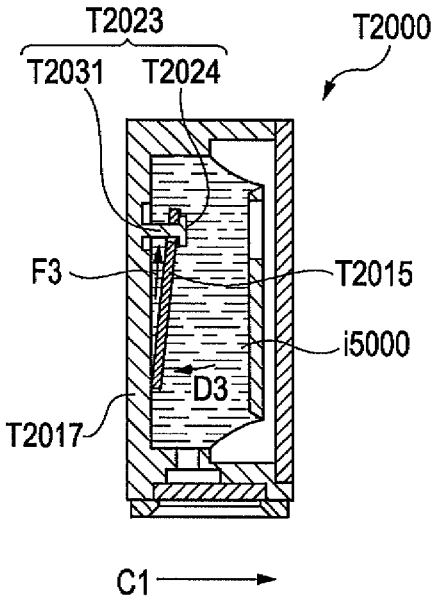
Figure 6D:
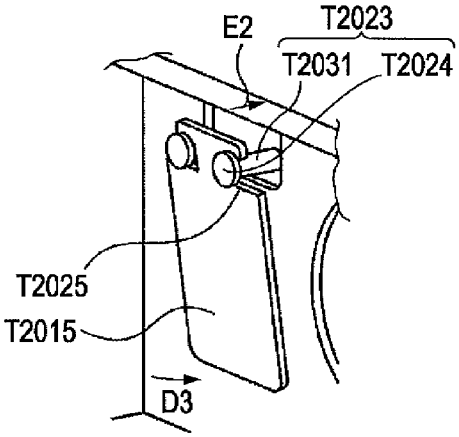

FIGS. 5D and 6D illustrate a fourth state of the agitating member T2015.

When the ink tank starts moving in the direction of the arrow C1 again in connection with the movement of the carriage in the opposite direction on the basis of the reciprocating motion, the second end of the agitating member first starts moving by action of inertial force such that the agitating member rotates about the supporting members in the direction of an arrow D3, and the agitating member comes into contact with the inner wall of the casing T2017.

Subsequently, the first end of the agitating member moves along the shafts of the supporting members in the direction of an arrow E2. While the agitating member T2015 approaches the inner wall of the container body, the ink located in the space between the agitating member and the inner wall moves in the direction of an arrow F3.

After the fourth state, the agitating member is returned to the first state shown in FIG. 5A.

A surface of the agitating member adjacent to the container body comes into contact with or is close to the inner wall of the container body, and the ink moves in the direction of an arrow F4. After this, the four states described above are repeated in connection with the reciprocal motion of the carriage.

[Effect of Agitation]

As described in the operation of the agitating mechanism, the agitating members utilize the inertial force generated by the movement of the carriage of the apparatus, and generate agitating motion by the rotation of the entire agitating members. During the agitation, the second (free) ends of the agitating members always move first due to the frictional resistance between the first ends of the agitating members and the supporting members, and subsequently, the first ends, whose motion is delayed due to the frictional resistance, start moving.

These motions cause the effect of generating ink flows from the second ends of the agitating members to the first ends so as to circulate the ink in the ink-storage chamber.

Furthermore, the second ends of the agitating members, which move widely, can be disposed in the lower portion of the container in the vertical direction where the supply port of the ink supplied to the recording head is located. With this structure, the pigment components settling in the lower portion of the ink-storage chamber can be agitated more reliably.

In combination with the above-described effect, the rotation of the entire agitating members can also agitate the ink remote from the supply port of the ink in addition to that in the vicinity of the supply port of the ink. Thus, the ink in the entire container can be agitated, and the non-uniformity of the density inclination in the container can be reduced.

With the above-described simplified structure according to this exemplary embodiment, liquid remote from the liquid-supplying portion in the liquid-storage chamber can also be agitated in addition to that in the vicinity of the liquid-supplying portion, and the non-uniformity of the density inclination in the container can be reduced.

In the present embodiment, the liquid storage chamber or reservoir is air-tight, such that the liquid is agitated without air being introduced into the liquid reservoir in use.

Second Embodiment

Figure 8:
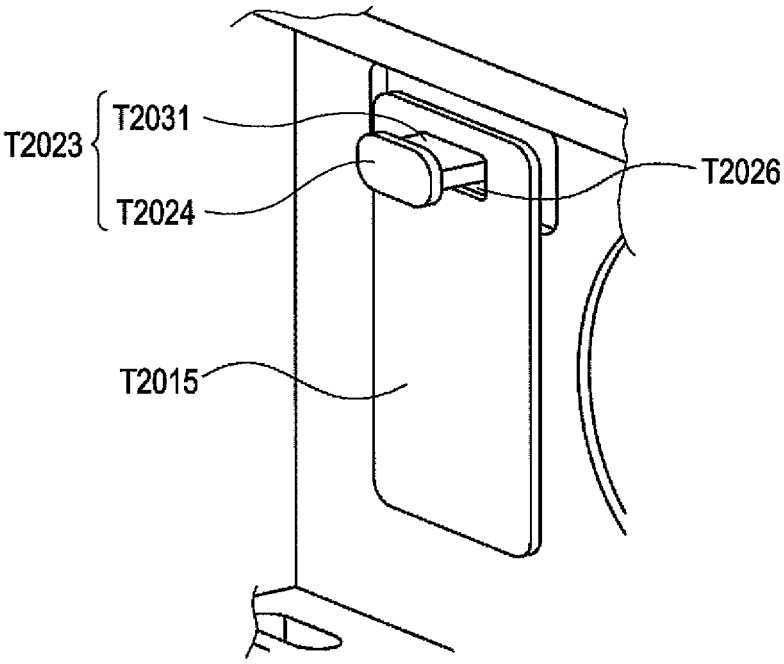
FIG. 8 is a perspective view illustrating a second exemplary embodiment of the present invention.
Figure 9:
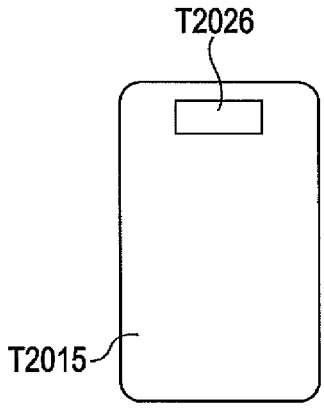
FIG. 9 is a plan view of an agitating member of a liquid container according to the second exemplary embodiment of the present invention.

FIG. 8 is a perspective view illustrating a second exemplary embodiment of the present invention, which is a modification of the liquid container of the present invention, and FIG. 9 is a plan view of an agitating member shown in FIG. 8.

An ink tank shown in FIG. 8 includes a supporting member T2023 having a tabular shaft and a retaining portion T2024 formed at the end of the shaft. As shown in FIG. 9, an agitating member T2015 has a rectangular hole T2026. According to this structure, a side of the rectangular hole of the agitating member is in contact with a surface (upper surface) of the tabular shaft of the supporting member.

The agitating member rotates by action of inertial force generated in response to the movement of the carriage. The contact portion between the lip of the hole of the agitating member and the supporting member functions as a rotation axis, and substantially the same agitating effect as in the first exemplary embodiment can be accomplished.

Third Embodiment

Figure 10:
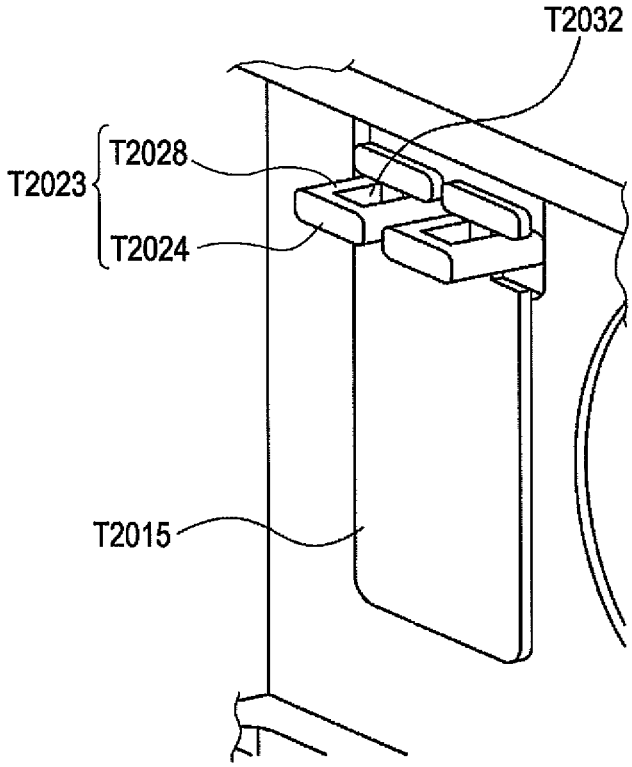
FIG. 10 is a perspective view illustrating a third exemplary embodiment of the present invention.
Figure 11:
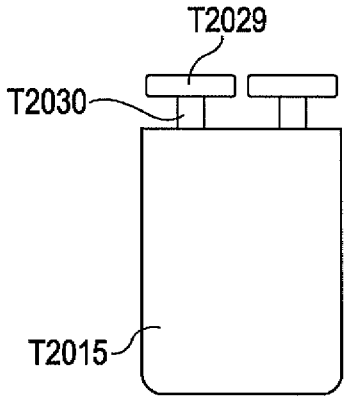
FIG. 11 is a plan view of an agitating member of a liquid container according to the third exemplary embodiment of the present invention.

FIG. 10 is a perspective view illustrating a third exemplary embodiment of the present invention, and FIG. 11 is a plan view of an agitating member shown in FIG. 10.

As shown in FIG. 10, an ink tank according to this exemplary embodiment includes supporting members T2023 each having a rail member T2028 with two rails parallel to each other and a retaining portion T2024 formed at the end of the rail member.

As shown in FIG. 11, the agitating member T2015 includes suspending portions T2029 suspended from the supporting members T2023, slender necks T2030 extending from the suspending portions in the vertical direction, and an agitating portion larger than the necks extending from the necks.

The rail members T2028 form slits T2032 into which the necks of the agitating member T2015 are fitted, and the agitating member is suspended from the supporting members by the suspending portions. Thus, the supporting members each having the two rail members parallel to the moving direction of the carriage function as the supporting members in a similar way to the first exemplary embodiment.

Figure 12:
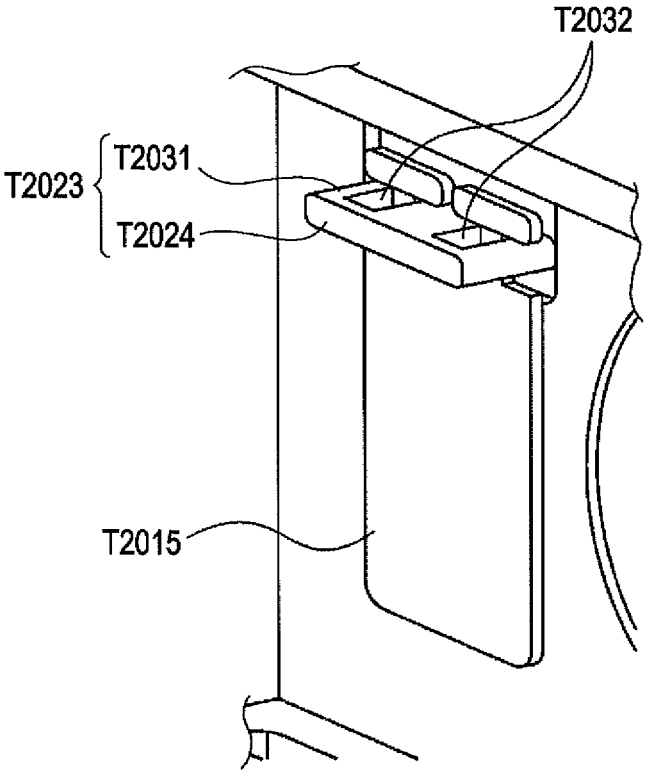
FIG. 12 is a modification of the third exemplary embodiment of the present invention.

Moreover, the supporting members T2023 may be integrated into one component and have a plurality of slits T2032 as shown in FIG. 12. Substantially the same agitating effect can be obtained also with this structure.

The supporting members shown in FIGS. 10 and 12 are composed of resin that is the same material as that of the container body, and may be fixed to the container body by ultrasonic welding after the necks T2030 of the agitating members are fitted into the slits T2032.

The supporting members support the agitating members such that the agitating members can move linearly along the rails of the supporting members and can rotate about the supporting members. With this simplified structure, ink in an ink-storage chamber can be agitated. Moreover, a supply port of the ink of a recording head may be disposed adjacent to the free ends of the agitating members, for example, in the lower portion of the container in the vertical direction. The supporting members may be disposed remote from the supply port, for example, in the upper portion of the container in the vertical direction.

With this structure, liquid remote from the liquid-supplying portion can also be agitated in addition to that in the vicinity of the liquid-supplying portion, and the non-uniformity of the density inclination in the container can be reduced.

Furthermore, the supporting members are not limited to columnar or tabular forms, and the portions of the supporting members at which the agitating members are engaged with the supporting members are not limited to slots or holes.

Any structure is permissible as long as the movement and the rotation of the agitating members are not obstructed by the sliding resistance generated during the reciprocation of the carriage.

Fourth Embodiment

Figure 13:
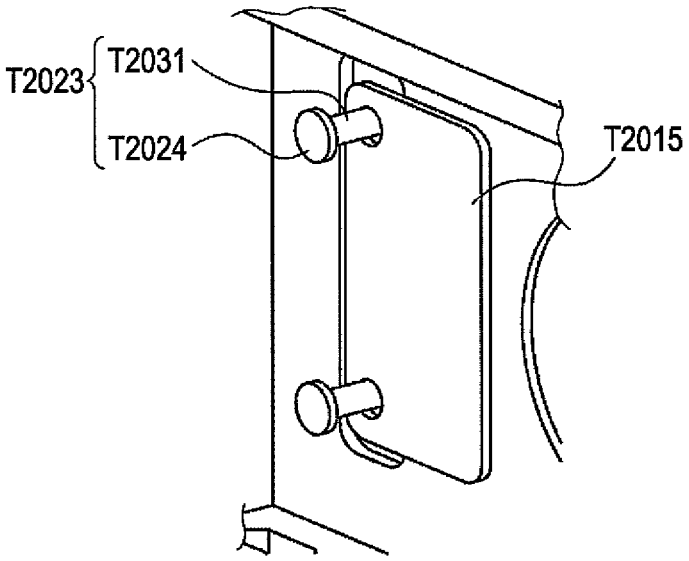
FIG. 13 is a perspective view illustrating a fourth exemplary embodiment of the present invention.
Figure 14:
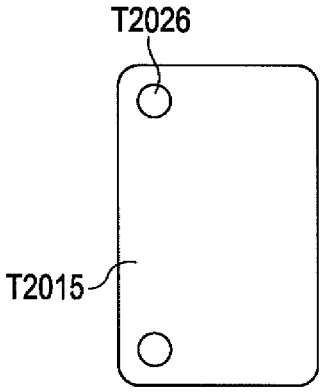
FIG. 14 is a plan view of an agitating member of a liquid container according to the fourth exemplary embodiment of the present invention.

FIG. 13 is a perspective view illustrating an ink tank according to a fourth exemplary embodiment of the present invention, and FIG. 14 is a plan view of an agitating member shown in FIG. 13.

As shown in FIG. 13, the ink tank in this exemplary embodiment includes two supporting members that are the same as those in the first exemplary embodiment disposed on the inner wall of an ink-storage chamber in a vertical direction one above the other. Also, as shown in FIG. 14, an agitating member T2015 has holes T2026 for passing through the supporting members at positions corresponding to those of the supporting members.

In this manner, the agitating member is not necessarily suspended from the supporting members disposed in the upper portion of the ink-storage chamber, and any structure is permissible as long as the supporting members support one end of the agitating member so as to be movable and rotatable about the supporting members.

According to all the exemplary embodiments of the present invention, liquid components in a liquid container can be agitated even when air is not taken into a liquid-storage chamber of the liquid container.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A liquid container comprising:

a liquid-storage chamber configured to store liquid;

a shaft provided in the liquid-storage chamber; and a movable plate member provided in the liquid-storage chamber, having a through hole and movably suspended by the shaft inserted into the through hole.

2. A liquid container according to claim 1, wherein the movable plate member is suspended by the shaft so that the movable plate member is movable on the shaft along an extending direction of the shaft.

3. A liquid container according to claim 2, further comprising:

a fixed portion provided on one end of the shaft and fixed on an inner wall of the liquid-storage chamber; and a stopper provided on another end of the shaft and configured to prevent the movable plate member from separating from the shaft, wherein the shaft extends from the fixed portion to the stopper in the extending direction.

4. A liquid container according to claim 3, wherein the extending direction is a direction intersecting with the inner wall.

5. A liquid container according to claim 4, further comprising:

a casing including the liquid-storage chamber, a supply port provided on the casing and configured to supply the liquid in the liquid-storage chamber to an outside of the casing, wherein when the liquid container is oriented with the supply port facing downward, the inner wall is a vertical wall and the extending direction is a horizontal direction orthogonal to the vertical wall.

6. A liquid container according to claim 5, wherein the movable plate member has an upper end and a lower end, the upper end and the lower end being defined by orientation when the liquid container is oriented with the supply port facing downward, and wherein the through hole is disposed closer to the upper end than to the lower end.

7. A liquid container according to claim 6, wherein the movable plate member is movably suspended by the shaft so that the movable plate member is swingable about a portion of the shaft being in contact with the movable plate member so that an amount of swing of the lower end is larger than that of the upper end.

8. A liquid container according to claim 7, wherein the movable plate member is movable on the shaft along the extending direction and swingable about the portion to agitate the liquid in the liquid-storage chamber.

9. A liquid container according to claim 8, further comprising:

the liquid stored in the liquid-storage camber and containing a pigment.

10. A liquid container according to claim 2, wherein the movable plate member is movably suspended by the shaft so that the movable plate member is swingable about a portion of the shaft being in contact with the movable plate member.

11. A liquid container according to claim 10, wherein the movable plate member is movable on the shaft along the extending direction and swingable about the portion to agitate the liquid in the liquid-storage chamber.

12. A liquid container according to claim 11, further comprising: the liquid stored in the liquid-storage chamber and containing a pigment.

13. A liquid container comprising:

a liquid-storage chamber configured to store liquid;

a first shaft provided on an inner wall of the liquid-storage chamber and extending from the inner wall toward an interior of the liquid-storage chamber in an extending direction;

a second shaft provided on the inner wall and extending from the inner wall toward the interior in the extending direction; and a movable plate member having a first through hole into which the first shaft is being inserted and a second through hole into which the second shaft is being inserted, the movable plate member being movably suspended by the first and second shafts so that the movable plate member is movable on the first and second shafts along the extending direction.

14. A liquid container according to claim 13, further comprising:

a first stopper provided on a head of the first shaft and configured to prevent the movable plate member from separating from the first shaft; and a second stopper provided on a head of the second shaft and configured to prevent the movable plate member from separating from the second shaft.

15. A liquid container according to claim 14, further comprising:

a casing including the liquid-storage chamber, a supply port provided on the casing and configured to supply the liquid in the liquid-storage chamber to an outside of the casing, wherein when the liquid container is oriented with the supply port facing downward, the inner wall is a vertical wall, the extending direction is a horizontal direction orthogonal to the vertical wall and a position of the first shaft in a vertical direction is the same as that of the second shaft.

16. A liquid container according to claim 15, wherein the movable plate member has an upper end and a lower end, the upper end and the lower end being defined by orientation when the liquid container is oriented with the supply port facing downward, wherein the first and second through holes are disposed closer to the upper end than to the lower end, and wherein the movable plate member is movably suspended by the first and second shafts so that the movable plate member is swingable about an axis passing through a first portion of the first shaft being in contact with the movable plate member and a second portion of the second shaft being in contact with the movable plate member so that an amount of swing of the lower end is larger than that of the upper end.

17. A liquid container according to claim 16, wherein the movable plate member is movable on the first and second shafts along the extending direction and swingable about the axis to agitate the liquid in the liquid-storage chamber.

18. A liquid container according to claim 17, further comprising: the liquid stored in the liquid-storage camber and containing a pigment.

19. A liquid container according to claim 13, wherein the movable plate member is movably suspended by the first and second shafts so that the movable plate member is swingable about an axis passing through a first portion of the first shaft being in contact with the movable plate member and a second portion of the second shaft being in contact with the movable plate member.

20. An ink jet printer comprising:

a liquid container;

a liquid ejecting head; and a carriage movable in a moving direction and capable of carrying the liquid container and the liquid ejecting head;

wherein the liquid container comprises;

a casing including a liquid-storage chamber storing a liquid to be supplied to the liquid ejecting head;

a supply port provided on the casing and configured to supply the liquid in the liquid-storage chamber to the liquid ejecting head;

a shaft provided on an inner wall of the liquid-storage chamber and extending from the inner wall toward an interior of the liquid-storage chamber in an extending direction along with the moving direction; and a movable plate member having a through hole and movably suspended by the shaft inserted into the through hole so that the movable plate member is movable on the shaft along the extending direction by movement of the carriage to agitate the liquid in the liquid-storage chamber.

21. An ink jet printer according to claim 20, wherein the movable plate member is movably suspended by the shaft so that the movable plate member is swingable about a portion of the shaft being in contact with the movable plate member by the movement of the carriage to agitate the liquid in the liquid-storage chamber.

22. An ink jet printer comprising:

a liquid container;

a liquid ejecting head; and a carriage movable in a moving direction and capable of carrying the liquid container and the liquid ejecting head, wherein the liquid container comprises;

a casing including a liquid-storage chamber storing a liquid to be supplied to the liquid ejecting head;

a supply port provided on the casing and configured to supply the liquid in the liquid-storage chamber to the liquid ejecting head;

a first shaft provided on an inner wall of the liquid-storage chamber and extending from the inner wall toward an interior of the liquid-storage chamber in an extending direction along with the moving direction;

a second shaft provided on the inner wall and extending from the inner wall toward an interior in the extending direction along with the moving direction; and a movable plate member having a first through hole into which the first shaft is being inserted and a second through hole into which the second shaft is being inserted, the movable plate member being movably suspended by the first and second shafts so that the movable plate member is movable on the first and second shafts along the extending direction by movement of the carriage to agitate the liquid in the liquid-storage chamber.

23. An ink jet printer according to claim 22, wherein the movable plate member is movably suspended by the first and second shafts so that the movable plate member is swingable about a portion of the first and second shafts being in contact with the movable plate member by the movement of the carriage to agitate the liquid in the liquid-storage chamber.

24. A liquid container comprising:

a liquid-storage chamber configured to store liquid;

a shaft provided in the liquid-storage chamber; and a plate member provided in the liquid-storage chamber, having an engaging portion and suspended by the shaft being loosely fitted into the engaging portion.

* * * * *